US005370096A

United States Patent [19]

Cooke

[11] Patent Number: 5,370,096

[45] Date of Patent: Dec. 6, 1994

[54] FUEL PUMP

[75] Inventor: Michael P. Cooke, Gillingham, United Kingdom

[73] Assignee: Lucas Industries Public Limited Company, Solihull, England

[21] Appl. No.: 171,739

[22] Filed: Dec. 22, 1993

[30] Foreign Application Priority Data

Dec. 22, 1992 [GB] United Kingdom ..... 9226669

[51] Int. Cl.[5] ..... F02M 37/04

[52] U.S. Cl. ..... 123/502; 123/179.17; 417/221; 417/462

[58] Field of Search ..... 417/221, 473, 497, 462; 123/502, 179.17, 449, 503

[56] References Cited

U.S. PATENT DOCUMENTS

| | | | |
|---|---|---|---|
| 3,314,406 | 4/1967 | Kemp | 123/502 |
| 4,333,437 | 6/1982 | Lohner | 123/502 |
| 4,354,474 | 10/1982 | Kobayashi | 123/502 |
| 4,359,995 | 11/1982 | Mowbray | 123/502 |
| 4,476,837 | 10/1984 | Salzgeber | 123/502 |
| 4,526,154 | 7/1985 | Didomenico | 123/502 |
| 4,535,745 | 8/1985 | Roca Nierga | 123/502 |
| 4,593,669 | 6/1986 | Igarashi | 123/502 |
| 4,610,234 | 9/1986 | Sakuranaka | 123/502 |

FOREIGN PATENT DOCUMENTS 2133183 3/1986 United Kingdom .

*Primary Examiner*—Carl S. Miller

*Attorney, Agent, or Firm*—Jacobson, Price, Holman & Stern

[57] ABSTRACT

A fuel pumping apparatus for supplying fuel to an internal combustion engine includes a first fluid pressure operable piston movable against the action of a spring to advance the timing of fuel delivery by the apparatus. The spring bears at its end remote from the piston against a spring abutment which is in the form of a further piston. The position of the further piston is controlled by a temperature responsive device and when the engine is hot the further piston is advanced from a first position to a second position. A first stop limits the movement of the first piston under increasing fluid pressure when the further piston is in its first position and is secured to the housing and a second stop limits the movement of the first piston under increasing fluid pressure when the further piston is in its second position the second stop being carried on the further piston.

10 Claims, 4 Drawing Sheets

FUEL PUMP

Figure 1:
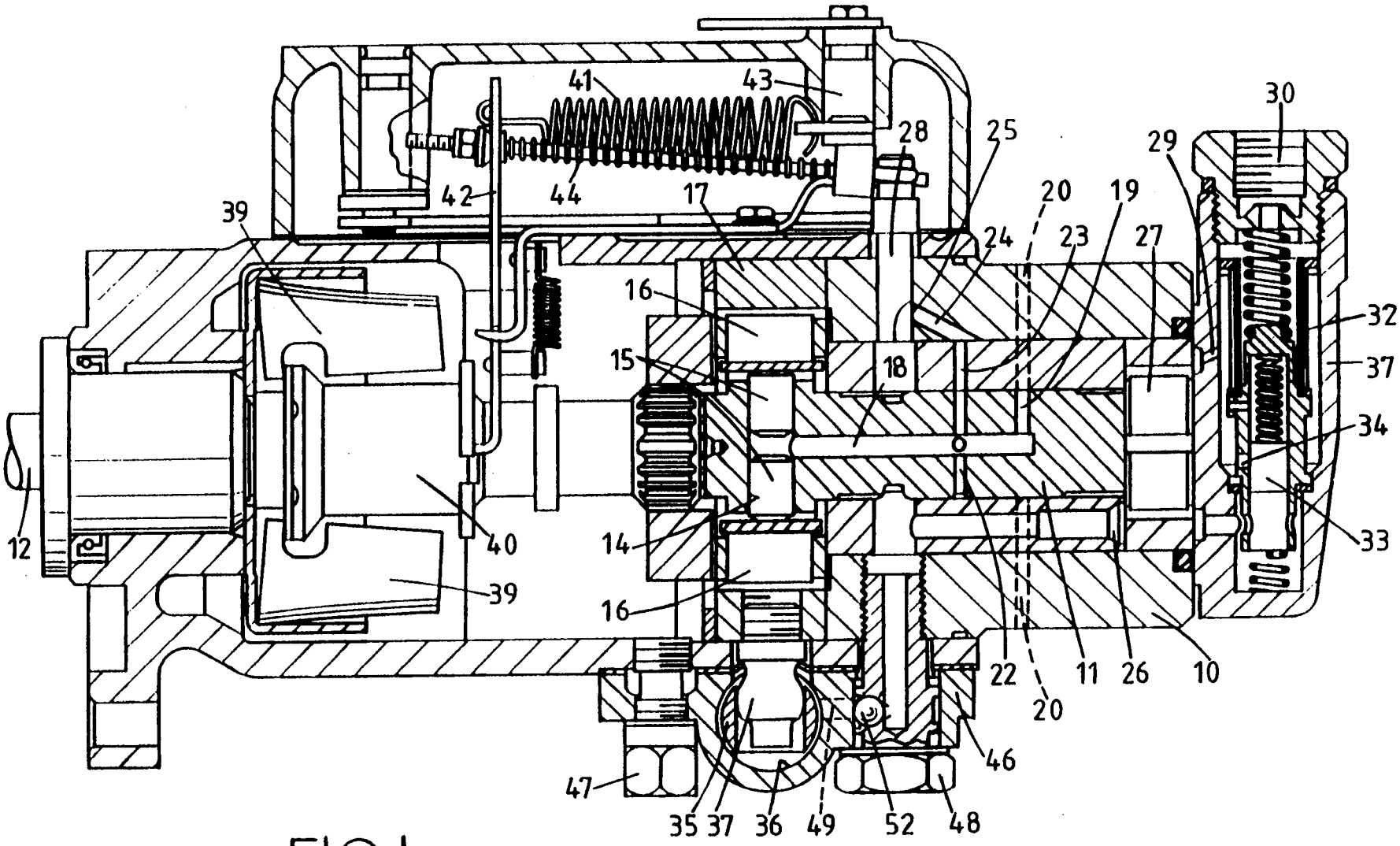

This invention relates to a fuel pumping apparatus for supplying fuel to a compression ignition engine, the apparatus including a pumping plunger mounted in a bore and movable inwardly in the bore to deliver fuel through an outlet, a cam mechanism for moving the plunger inwardly in timed relationship with the associated engine, a fluid pressure operable piston coupled to a part of said cam mechanism, and means for applying to said piston a fluid the pressure of which varies in accordance with the speed at which the apparatus is driven whereby the timing of fuel delivery through said outlet can be varied.

An example of such an apparatus is seen in GB-B-2133183 in which the plunger is mounted within a transverse bore formed in a rotary distributor member and is actuated by means of cam lobes formed on the internal surface of a cam ring which surrounds the distributor member. The cam ring is angularly adjustable about the axis of rotation of the distributor member such adjustment being effected by a spring loaded piston which is subjected to the outlet pressure of a low pressure fuel supply pump. A relief valve is provided so that the outlet pressure of the pump increases as the speed of the associated engine increases. The piston is arranged so that as the engine speed increases the timing of fuel delivery by the apparatus is advanced to compensate for the delay in the transmission of the pressure wave between the outlet and the injection nozzle and also for the ignition delay period following injection of fuel to the engine.

With modern engines it is usual to operate the engine when hot with the timing of delivery retarded in order to minimise noise and in particular NOx emissions. When the engine is cold however the timing of delivery must be advanced as compared to when it is hot in order to avoid the generation of white smoke in the engine exhaust. Moreover, even when the engine is cold it is necessary to provide for advance of the timing of fuel delivery with increase of speed.

The object of the invention is to provide an apparatus of the kind specified in a simple and convenient form.

According to the invention an apparatus of the kind specified includes a first spring abutment engageable by the piston under the action of the fluid pressure, a second spring abutment, a coiled spring acting intermediate the abutments, the force exerted by said spring opposing the force exerted by the fluid pressure acting on said piston to provide for advance of the timing of fuel delivery with increasing engine speed, temperature responsive means for moving the second spring abutment from a first position to a second position when the engine temperature increases, such movement of the second spring abutment being in the direction to move the piston to retard the timing of fuel delivery, a first stop secured relative to the body of the apparatus and operable to limit the movement of the first spring abutment and the piston against the action of the spring when the second spring abutment is in said first position, and a second stop operable to limit the movement of the first spring abutment and the piston against the action of the spring when the second spring abutment is in said second position.

Figure 2:
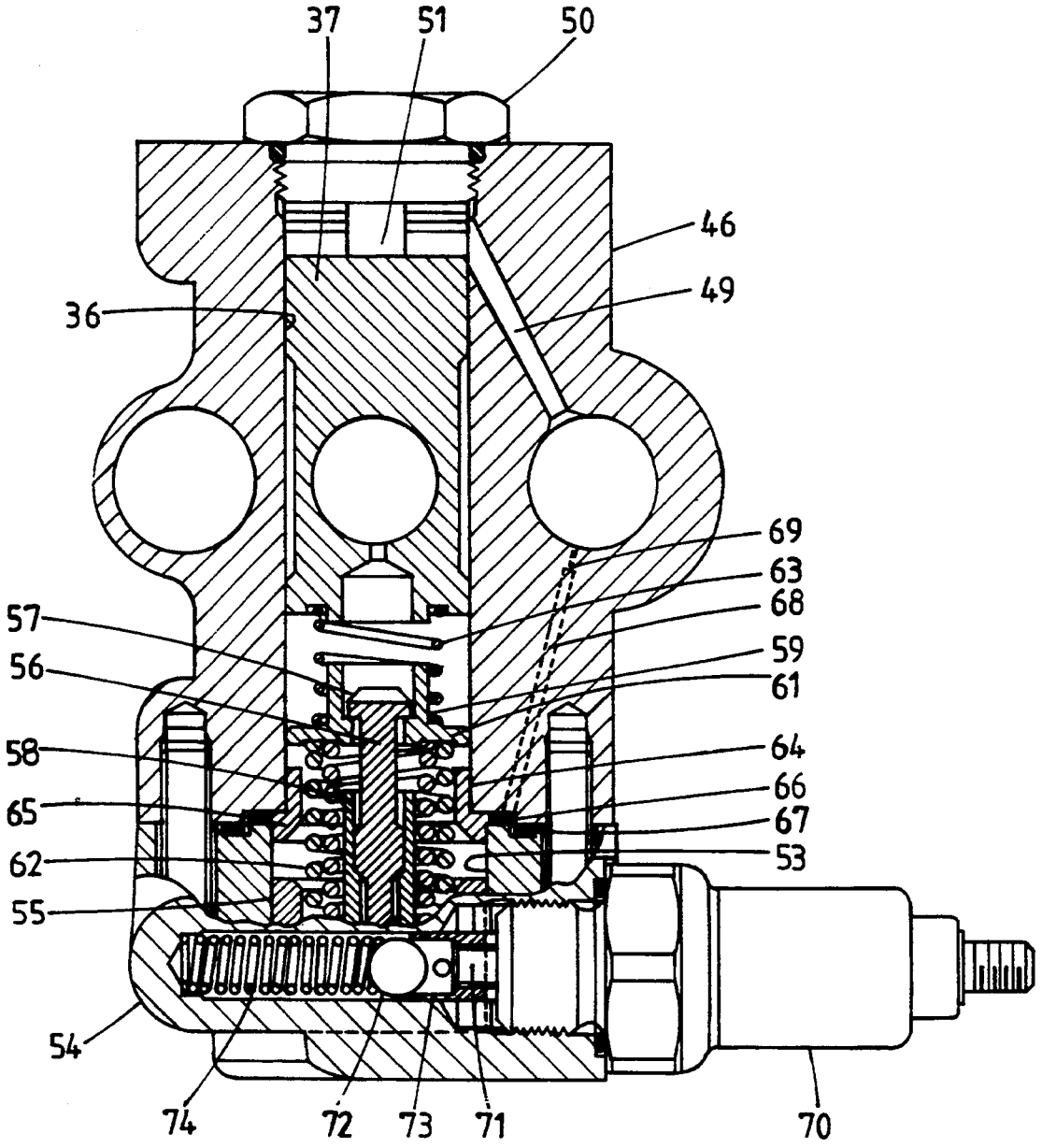
Figure 7:
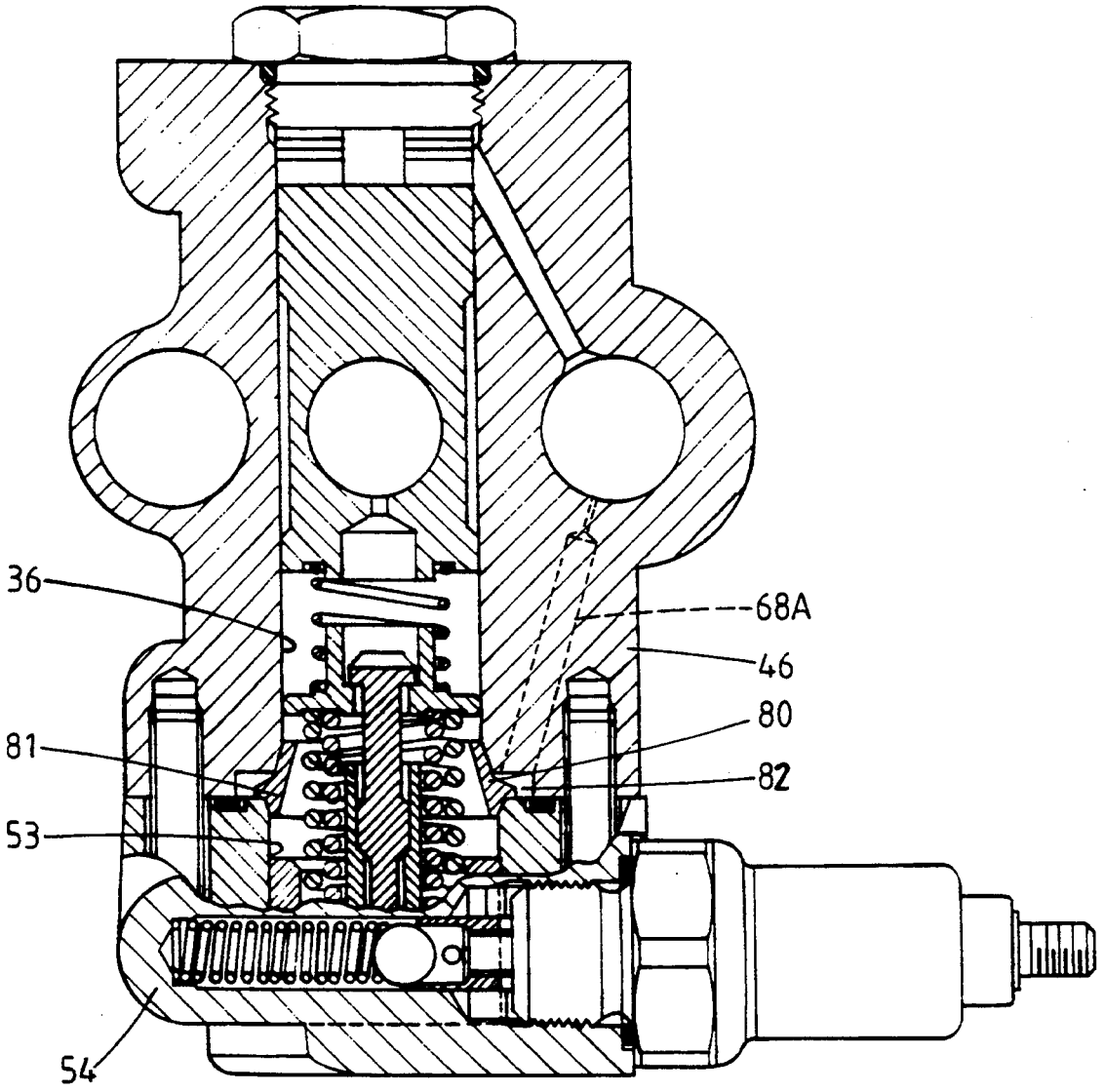

In the accompanying drawings:

FIG. 1 is a sectional side elevation of one example of a fuel pumping apparatus to which the invention may be applied, FIG. 2 is a sectional plan view of part of the apparatus shown in FIG. 1, FIGS. 3–6 are views corresponding to FIG. 2 showing the components in different working positions, and FIG. 7 is a view similar to FIG. 2 showing a modification.

Referring to FIG. 1 of the drawings the apparatus comprises a pump body 10 in which is mounted a rotary cylindrical distributor member 11. The distributor member is coupled to a drive shaft 12 which in use is driven by a rotary part of the associated engine. Formed within the distributor member is a transverse bore 14 in which is located a pair of reciprocable pumping plungers 15. The plungers 15 are arranged to be moved inwardly as the distributor member rotates, by means of cam followers including rollers 16, engageable with cam lobes formed on the internal peripheral surface of an annular cam ring 17 which is mounted for angular movement within the body 10.

Formed in the distributor member is a longitudinally extending passage 18 which at one end communicates with the bore 14 and at its other end, communicates with a radially disposed delivery passage 19. The delivery passage is arranged to register in turn with a plurality of equi-angularly spaced outlets 20 which in use, are connected to the injection nozzles respectively of the associated engine. The registration of the passage 19 with one of the outlets 20 takes place during the whole time the plungers 15 are capable of being moved inwardly so that liquid fuel contained within the bore 14 will be displaced to a combustion space of the associated engine.

At another point the longitudinal passage 18 communicates with a plurality of equi-angularly spaced inlet passages 22 which are arranged to register in turn with an inlet port 23 formed in the body and in communication with a control port 25 by way of a passage 24. The control port 25 communicates with the outlet 26 of a low pressure feed pump 27 by way of a slot formed in an angularly adjustable throttle member 28. By adjusting the angular setting of the throttle member, the effective size of the control port 25 is varied so that when an inlet passage 22 is in register with the inlet port 24, the amount of fuel which is supplied to the bore 14 can be controlled. The registration of an inlet passage 22 with the inlet port 23 takes place during the time when the delivery passage 19 is out of register with an outlet and when the rollers are clear of the cam lobes. The angular setting of the throttle member 28 therefore determines the amount of fuel which can be supplied to the associated engine. As the distributor member rotates fuel will be fed to the outlets 20 in turn.

The low pressure feed pump 27 is provided with an inlet which is in communication with an inlet port 30 formed in a hollow part 37 mounted on the pump body 10. The inlet 30 communicates with the fuel inlet of the low pressure pump 27 by way of a passage 29 and a tubular fuel filter element 32 is provided to filter the fuel flowing to the pump inlet. The part 37 also houses a relief valve in the form of spring loaded plunger 33 one end of which is exposed to the outlet pressure of the low pressure pump so that the size of a spill port 34 is controlled. The low pressure pump 27 always delivers more fuel than is required for supply to the engine and since the element 33 is spring-loaded, the outlet pressure of the low pressure pump varies in accordance with the speed at which the pump is operated.

The cam ring 17 as mentioned, is angularly adjustable so that the timing of delivery of fuel to the engine can be modified. The adjustment of the cam ring is achieved by means of a piston 35 which is mounted in a cylinder 36 and a peg 37, coupled to the cam ring is located within an aperture in the piston 35 to convert axial movement of the piston within its cylinder to angular movement of the cam ring.

The angular setting of the throttle valve 28 is conveniently controlled by a mechanical governor means which includes weights 39 accommodated within a cage driven by the shaft 12. The weights are coupled by a linkage to the throttle member 28. The weights engage an axially movable collar 40 slidable upon the drive shaft and the collar bears against one end of a lever 42 the other end of which is coupled to one end of a coiled tension spring 41. The other end of the tension spring is connected to a manually operable member 43 which in the case where the engine is for driving a vehicle would be coupled to the throttle pedal of the vehicle. The other end of the lever is also connected by means of a tie rod 44, to a radial arm mounted on the throttle member 28.

As shown in FIG. 1 the governor mechanism is what is known in the art as an "all speed" governor and for a given setting of the angularly adjustable member 43, as the speed of the associated engine increases, the weights will move outwardly against the action of the force exerted by the spring 41. In so doing, the lever 42 pivots and the throttle member 28 is moved to reduce the supply of fuel to the engine.

The cylinder 36 is formed in a housing 46 which is secured to the pump body 10 by means of a pair of bolts 47, 48. The bolt 48 is drilled to provide communication between the outlet 26 of the low pressure pump and a passage 49 in the housing 46 and which communicates with one end of the cylinder 36. This end of the cylinder is closed by a plug 50 which also defines a stop 51 to limit the extent of movement of the piston in the direction to retard the timing of fuel delivery by the apparatus. The bolt 48 also defines a seating for a ball 52 which serves as an anti-shock valve.

The cylinder 36 extends through the housing 46 and opens into a cylinder 53 of larger diameter and which is formed in an end closure 54 which is secured to the housing. Slidable within the cylinder 53 is a so called second spring abutment in the form of a cup shaped piston 55 which has a boss upstanding from its base wall. The boss is provided with a screw threaded aperture in which is received a screw threaded rod 56 having an enlarged head 57 at its end remote from the boss, and an intermediate portion which defines a step to engage with a complementary step formed in a tubular member 58. One end of the tubular member is held in engagement with the boss and its other end forms a second stop as will be explained.

The head 57 of the rod 56 is located within a central bore of a sleeve, the sleeve being provided with a flange 61 which forms a so called first spring abutment. Interposed between the flange 61 and the base wall of the piston 55 is a pair of coiled compression springs 62 disposed one within the other and when the engine is at rest the head 57 as shown in FIG. 2, engages a step in the central bore of the sleeve to limit the extension of the springs. Interposed between the piston 37 and the flange 61 is a further coiled compression spring 63 and in the rest position the spring 63 biases the piston 37 into engagement with the stop 51 and the piston 55 into engagement with the end wall of the cylinder 53.

Located at the junction of the housing 46 and the end closure 54 is an annular stop element having a first portion 64 which lies within the cylinder 36 and a second portion 65 which lies within the cylinder 53.

The stop element is provided with a peripheral flange which extends partly into an inner annular pocket defined in the end wall of the housing 46. Adjacent the flange is located a seal ring 66 which is of a size so as to leave the outer portion of the pocket free. An outer pocket is formed in the end face of the end closure 54 and a further seal ring 67 is located in this pocket and is of a size so as to leave the inner portion of the pocket free. The free portions of the pockets define a fuel supply channel to a valve which will be described and the channel communicates with the outlet of the low pressure pump by way of a passage 68 formed in the housing and incorporating a restrictor 69.

The end surface of the portion 64 of the stop element constitutes a first stop and is engageable by the flange 61 and the end surface of the second portion of the stop element is engageable by the piston 55. When the piston 55 is in engagement with the end wall of the cylinder it is said to be in its first position and when it is in engagement with the portion 65 it is said to be in its second position.

The piston 55 is moved from its first position to its second position when the engine temperature reaches a predetermined value. Any convenient mechanism can be employed for this purpose but it is convenient to use a valve including a valve member which is lifted from its seating by the action of an electrically heated wax motor 70 which is secured in the end closure 54. The heating element of the wax motor is controlled by a temperature responsive switch which is responsive to engine temperature. The wax motor has an output member 71 which extends further from the body of the motor when the engine temperature increases to said predetermined value. The valve comprises a valve member in the form of a ball 72 which is urged onto a seating defined at the end of the tubular member 73 by means of a spring 74. The output member 71 extends within the tubular member 73 and an opening is formed in the wall of the tubular member, the opening communicating with the inner end of the cylinder 53. The spring 74 is located in a blind drilling which is in communication with the aforesaid fuel supply channel defined by the free portions of the pockets.

In operation, assuming that the associated engine is cold and is at rest. The piston 37 has the position as shown in FIG. 2 that is to say the piston and the cam ring 16 are in the fully retarded position this being the position required for starting the engine. When the engine starts the output pressure of the low pressure pump is applied by way of the passage 49, to the piston which moves in the direction of advance against the action of the spring 63, into engagement with the sleeve 59 and assumes the position shown in FIG. 6.

This position of the piston represents the minimum advance for a cold engine and as the engine speed increases the piston and the first spring abutment constituted by the flange 61 move against the action of the spring 62 until the flange engages the end of the portion 64 of the stop ring. This is the position shown in FIG. 5 and represents the maximum advance of the piston 37 for a cold engine.

Figure 3:
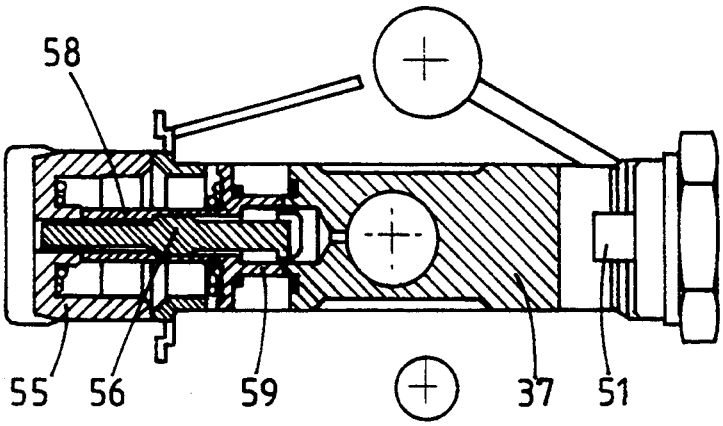
Figure 4:
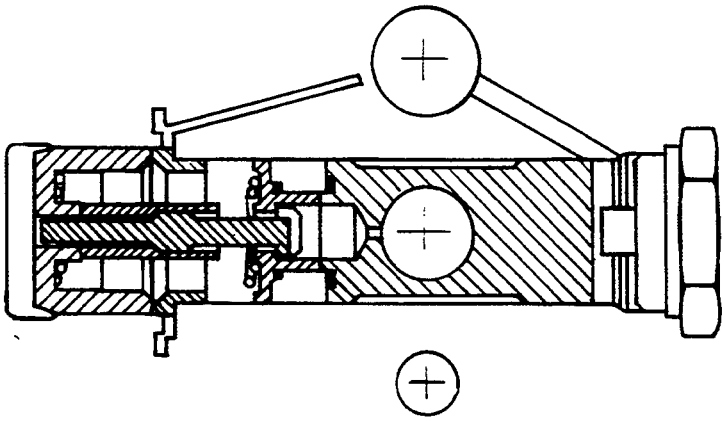
Figure 5:
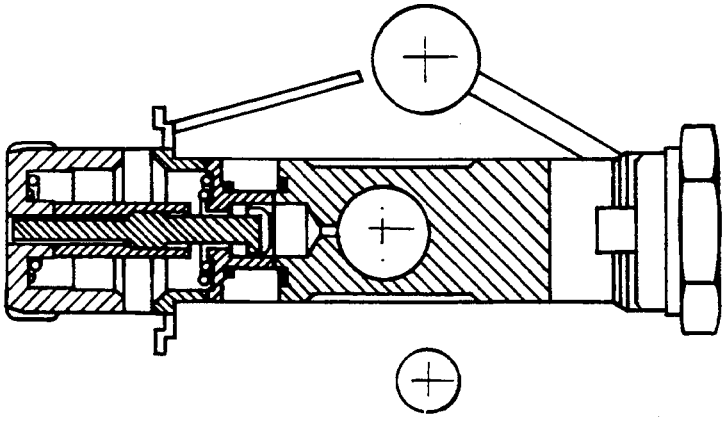
Figure 6:
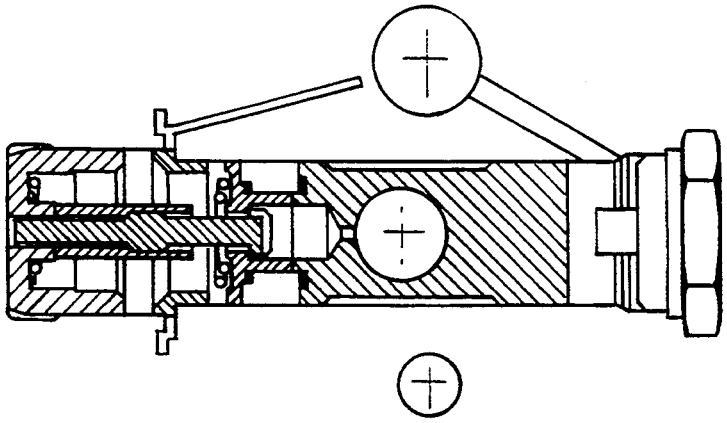

As the engine temperature increases to the predetermined value, the ball 72 is lifted from its seating to allow fuel at the output pressure of the low pressure pump to act upon the piston 55. Since the piston 55 is larger in area than the piston 37 it will move into engagement with the end of the portion 65 i.e., from its first position to its second position as shown in FIGS. 3 and 4. During this movement of the piston 55 all the components connected to the piston together with the piston 37 will move in the retard direction. If the engine is operating at low speed the various components move from the position shown in FIG. 6 to the position shown in FIG. 4. In this position the engagement of the under surface of the head 57 of the rod 56 with the step in the sleeve 59 determines the position of the piston 37. If the engine is operating at high speed the components move from the position shown in FIG. 5 to the position shown in FIG. 3 and in this position the engagement of the sleeve 59 with the end of the tubular member 58 determines the position of the piston 37. It will be noted by comparing the two FIGS. 3 and 5 that when the engine is operating at high speed the maximum degree of advance is slightly less when the engine is hot than when it is cold. Moreover by comparing FIGS. 4 and 6 it can be seen that when the engine is cold the minimum degree of advance is greater than when the engine is hot. During displacement of the pistons fuel can escape from or flow into the space defined between the pistons by way of a bleed opening formed in the piston 37.

The apparatus described is of the type in which the timing of fuel delivery depends upon the amount of fuel which is being supplied by the apparatus. When a small quantity of fuel is being supplied the timing of delivery is retarded and in this situation it is arranged that the output pressure of the low pressure pump is increased to provide a measure of compensation.

The anti shock valve formed by the ball 52 is to minimise movement of the piston 37 when it experiences the reaction between the rollers 16 and the leading flanks of the cam lobes. The purpose of the restrictor 69 is to damp any pressure spikes and also to limit the rate at which fuel flows into the cylinder 67 when the wax motor lifts the ball 72 from its seating.

The annular stop element which defines the stop portions 64 and 65 is in the example described provided with a peripheral flange which is trapped between faces of the housing 46 and the end closure 54 and is located in an inner annular pocket defined in the housing. The pocket also contains the seal ring 66. In a modification the flange of the stop element is shaped to define on its end faces, knife edges respectively which when the end closure is secured to the housing bite into the material forming the end closure and the housing to form seals therewith. The sealing ring 66 is therefore no longer required and positive location of the stop element is ensured.

A further modification of the annular stop element is seen in FIG. 7 and from this figure it will be seen that the element 80 is of generally annular truncated conical form with the continuous rib 81 on its outer surface. Formed in the end wall of the housing 46 and surrounding the entrance to the cylinder 36 is a pocket 82 and the end portion of the cylinder flares outwardly to the pocket. The annular stop element 80 is engaged with the flared surface and the rib 81 lies within the pocket. The entrance to the cylinder 53 is also flared and the portion of the outer surface of the stop element which lies between the rib and the wider end of the element is shaped to engage the flared surface. When the end closure 54 is secured to the housing 46 the stop element is lightly pinched to establish a fuel tight seal to prevent escape of fuel under pressure from the pocket into the space intermediate the pistons. The construction described allows for a larger diameter of the passage 68A.

I claim:

1. A fuel pumping apparatus for supplying fuel to a compression ignition engine including a pumping plunger mounted in a bore and movable inwardly in the bore to deliver fuel through an outlet, a cam mechanism for moving the plunger inwardly in timed relationship with the associated engine, a fluid pressure operable piston coupled to a part of said cam mechanism, passage means through which fluid at a pressure which varies in accordance with the speed at which the apparatus is driven can be applied to the piston so that the timing of fuel delivery through the outlet can be varied, a first spring abutment engagable by the piston under the action of the fluid pressure, a second spring abutment, a coiled spring acting intermediate the abutments, the force exerted by said spring opposing the force exerted by the fluid pressure acting on said piston to provide for advance of the timing of fuel delivery with increasing engine speed, temperature responsive means operable to move the second spring abutment from a first position to a second position when the engine temperature increases, such movement of the second spring abutment being in the direction to move the piston to retard the timing of fuel delivery, a first stop secured relative to the body of the apparatus and operable to limit the movement of the first spring abutment and the piston against the action of the spring when the second spring abutment is in said first position, and a second stop operable to limit the movement of the first spring abutment and the piston against the action of the spring when the second spring abutment is in said second position.

2. A fuel pumping apparatus according to claim 1, in which said second spring abutment is in the form of a further piston slidable in a cylinder, and said temperature responsive means includes a valve operable to admit fluid under pressure into the cylinder to displace the further piston from the first position to the second position.

3. A fuel pumping apparatus according to claim 2, in which said further piston carries a rod having a head engagable by the first spring abutment to limit the separation of the spring abutments under the action of the spring.

4. A fuel pumping apparatus according to claim 3, in which said second stop comprises a tubular member located about said rod.

5. A fuel pumping apparatus according to claim 2, including an annular stop element having a first portion which lies within a further cylinder housing the first mentioned piston, said first portion defining said first stop and a second portion housed within said first mentioned cylinder, said second portion acting to determine said second position of the further piston.

6. A fuel pumping apparatus according to claim 5, in which said annular stop element is provided with a peripheral flange which is trapped between surfaces defined by a housing in which said first mentioned cylinder is formed and an end closure in which said further cylinder is formed, said surfaces defining an annular pocket which forms part of a fluid supply channel to said first mentioned cylinder.

7. A fuel pumping apparatus according to claim 6, in which said pocket is defined in part by an annular sealing ring which surrounds said flange.

8. A fuel pumping apparatus according to claim 6, in which the end surfaces of said flange define knife edges which bite into the material forming the housing and the end closure to form seals therewith.

9. A fuel pumping apparatus according to claim 5, in which the said first mentioned cylinder is larger in diameter than the further cylinder.

10. A fuel pumping apparatus according to claim 9, including a pocket surrounding the entrance to the further cylinder, said further cylinder flaring outwardly to said pocket, said annular member defining a frusto conical outer surface for sealing engagement with said flared surface, and a rib located in said pocket, said rib being shaped to engage a shaped surface of an end closure in which said first mentioned cylinder is formed.

* * * * *